US009877364B2

(12) United States Patent
Hong et al.

(10) Patent No.: US 9,877,364 B2
(45) Date of Patent: Jan. 23, 2018

(54) BACKLIGHT UNIT

(71) Applicant: SAMSUNG DISPLAY CO., LTD., Yongin-si, Gyeonggi-do (KR)

(72) Inventors: Jintaek Hong, Asan-si (KR); Jinwon Jang, Asan-si (KR); Daesik Lee, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/176,632

(22) Filed: Jun. 8, 2016

(65) Prior Publication Data

US 2016/0366737 A1 Dec. 15, 2016

(30) Foreign Application Priority Data

Jun. 12, 2015 (KR) ..... 10-2015-0083383

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01)

(58) Field of Classification Search
CPC .... H02M 1/36; H05B 33/0815; H05B 41/285
USPC ..... 315/224
See application file for complete search history.

(56) References Cited

U.S. PATENT DOCUMENTS

2008/0252236 A1* 10/2008 Lee ..... H05B 33/0818 315/308
2009/0146633 A1* 6/2009 Karasawa ..... H02M 1/36 323/290
2010/0117618 A1* 5/2010 Cheng ..... H02M 1/32 323/293
2011/0001434 A1* 1/2011 Hsu ..... H05B 33/0818 315/186
2011/0298834 A1* 12/2011 Shin ..... G09G 3/3406 345/690
2013/0033184 A1* 2/2013 Lee ..... H05B 33/0851 315/186
2014/0197739 A1* 7/2014 Lu ..... H05B 33/0815 315/122
2015/0117072 A1* 4/2015 Jao ..... H02M 1/36 363/21.17
2016/0359422 A1* 12/2016 Yuan ..... H02H 9/001

FOREIGN PATENT DOCUMENTS

KR 1020020017358 A 3/2002
KR 1020020045462 A 6/2002
KR 1020040003220 A 1/2004
KR 1008287390000 B1 5/2008
KR 1012248180000 B1 1/2013

* cited by examiner

*Primary Examiner* — Don Le
(74) *Attorney, Agent, or Firm* — Cantor Colburn LLP

(57) ABSTRACT

A backlight unit which significantly reduces overshoot of a light source driving current and audible noise includes a light source driven by a light source driving voltage, a light source controller controlling the light source driving voltage, and a soft starter generating a first soft start voltage by receiving a charge signal from the light source controller and outputting the first soft start voltage to the light source controller, and generating a second soft start voltage when the charge signal is not applied thereto and outputting the second soft start voltage to the light source controller.

12 Claims, 14 Drawing Sheets

BACKLIGHT UNIT

This application claims the priority to Korean Patent Application No. 10-2015-0083383, filed on Jun. 12, 2015, and all the benefits accruing therefrom under 35 U.S.C. § 119, the content of which in its entirety is herein incorporated by reference.

BACKGROUND

1. Field

Exemplary embodiments of the invention relate to a backlight unit, and more particularly, to a backlight unit capable of significantly reducing the overshoot of a light source driving current and audible noise.

2. Description of the Related Art

Since a liquid crystal display ("LCD") device uses liquid crystals which are non-emission elements, the LCD device includes backlight units for generating light.

Backlight units may be controlled in a dimming scheme to enhance image quality. When such dimming control is performed, a level of a light source driving voltage applied to a light source varies. The light source emits light by a light source driving current generated by the light source driving voltage.

SUMMARY

When a level of a light source driving voltage increases, a level of the light source driving current also increases. Thus, due to the relatively high level of the light source driving voltage, overshoot may occur in the light source driving current. Accordingly, the overshoot of the light source driving current may cause an increase in the magnitude of audible noise of the backlight unit.

Exemplary embodiments of the invention are directed to a backlight unit capable of reducing audible noise by significantly reducing the overshoot of a light source driving current.

According to an exemplary embodiment of the invention, a backlight unit includes a light source driven by a light source driving voltage, a light source controller controlling the light source driving voltage, and a soft starter generating a first soft start voltage by receiving a charge signal from the light source controller and outputting the first soft start voltage to the light source controller, and generating a second soft start voltage when the charge signal is not applied thereto and outputting the second soft start voltage to the light source controller.

In an exemplary embodiment, the soft starter may include a soft start capacitor connected between an input terminal of the light source controller and ground, and an electric element connected between the input terminal of the light source controller and the ground.

In an exemplary embodiment, the electric element may include at least one of a resistor, an inductor, a capacitor, and a switching element.

In an exemplary embodiment, the soft starter may further include a resistor connected between the input terminal of the light source controller and the soft start capacitor.

In an exemplary embodiment, the soft starter may further include a discharge switching element controlled based on an externally applied discharge control signal, the discharge switching element being connected between the electric element and the ground.

In an exemplary embodiment, the backlight unit may further include a three-dimensional ("3D") image dimming controller outputting, as the discharge control signal, one of a 3D image dimming enable signal and an inverted 3D image dimming pulse width modulation ("PWM") signal.

In an exemplary embodiment, the backlight unit may further include a discharge controller outputting the discharge control signal based on a duty ratio of the externally applied dimming control signal.

In an exemplary embodiment, the discharge controller may output the discharge control signal when a duty ratio of the dimming control signal is greater than a predetermined reference duty ratio.

In an exemplary embodiment, the light source controller may include a light source driving current detector generating a detection voltage based on a light source driving current of the light source generated based on the light source driving voltage, a feedback signal generator generating a feedback signal based on one of the first and second soft start voltages and the detection voltage, an output controller generating a switch control signal based on the feedback signal, a power converter converting an externally applied input voltage into a light source driving voltage based on the switch control signal to apply the converted light source driving voltage to the light source, a dimming controller controlling the light source driving current based on an externally applied dimming control signal, and a soft start controller controlling the soft starter based on the dimming control signal.

In an exemplary embodiment, the backlight unit may further include a discharge switching element controlled based on an externally applied discharge control signal, the discharge switching element being connected between ground and an input terminal of the dimming controller to which the dimming control signal is input.

In an exemplary embodiment, the backlight unit may further include a discharge switching element controlled based on an externally applied discharge control signal, the discharge switching element being connected between an output terminal of the power converter and ground.

In an exemplary embodiment, the soft start controller may supply the charge signal to the soft starter during a duty-on period of the dimming control signal.

In an exemplary embodiment, an electric connection between the soft start controller and the soft starter may be cut off during a duty-off period of the dimming control signal.

BRIEF DESCRIPTION OF THE DRAWINGS

The above and other features and exemplary embodiments of invention will be more clearly understood from the following detailed description taken in conjunction with the accompanying drawings, in which.

DETAILED DESCRIPTION

Figure 1:
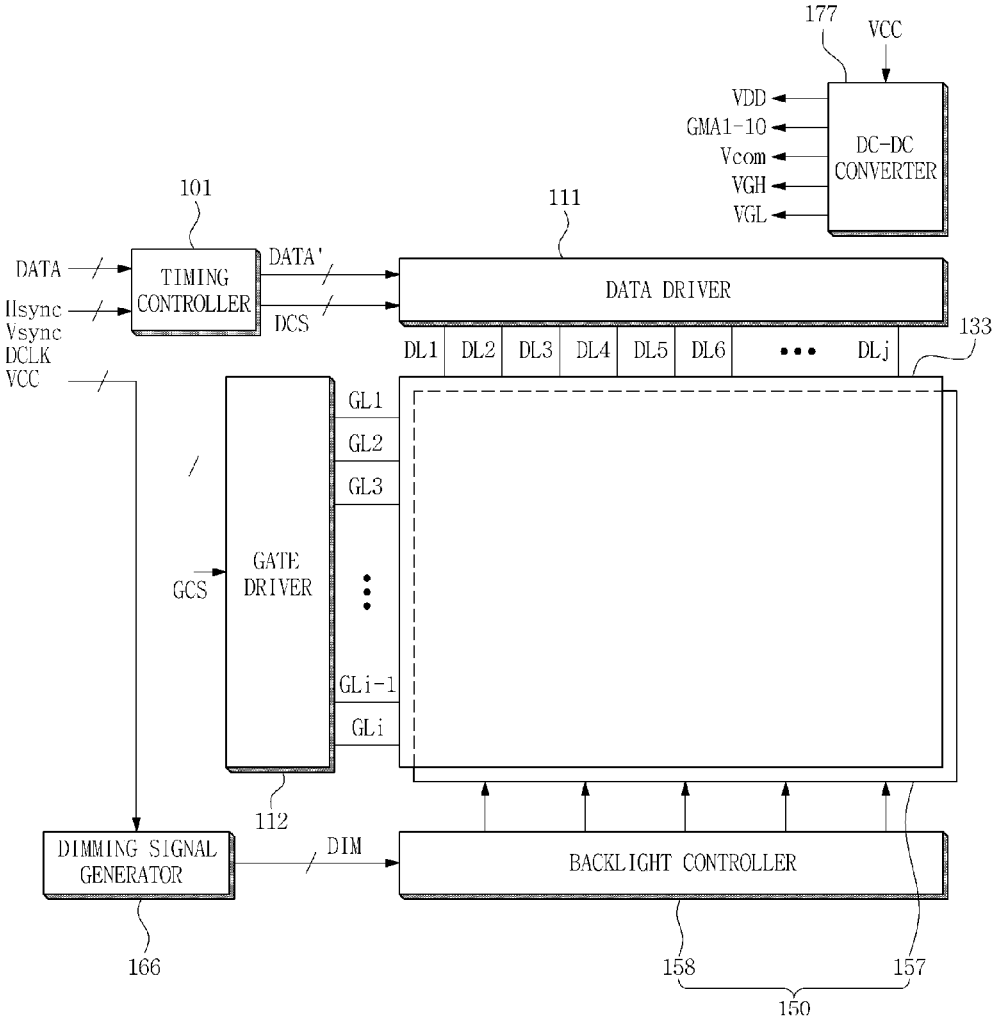
FIG. 1 is a block diagram illustrating a display device according to an exemplary embodiment.

Advantages and features of the invention and methods for achieving them will be made clear from exemplary embodiments described below in detail with reference to the accompanying drawings. The invention may, however, be embodied in many different forms and should not be construed as being limited to the exemplary embodiments set forth herein. Rather, these exemplary embodiments are provided so that this invention will be thorough and complete, and will fully convey the scope of the invention to those skilled in the art. The invention is merely defined by the scope of the claims. Therefore, well-known constituent elements, operations and techniques are not described in detail in the exemplary embodiments in order to prevent the invention from being obscurely interpreted. Like reference numerals refer to like elements throughout the specification.

Throughout the specification, when an element is referred to as being "connected" to another element, the element is "directly connected" to the other element, or "electrically connected" to the other element with one or more intervening elements interposed therebetween. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" can be termed likewise without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms used herein (including technical and scientific terms) have the same meaning as commonly understood by those skilled in the art. It will be further understood that terms, such as those defined in commonly used dictionaries, should be interpreted as having a meaning that is consistent with their meaning in the context of the relevant art and will not be interpreted in an ideal or excessively formal sense unless clearly defined in the specification.

Figure 2:
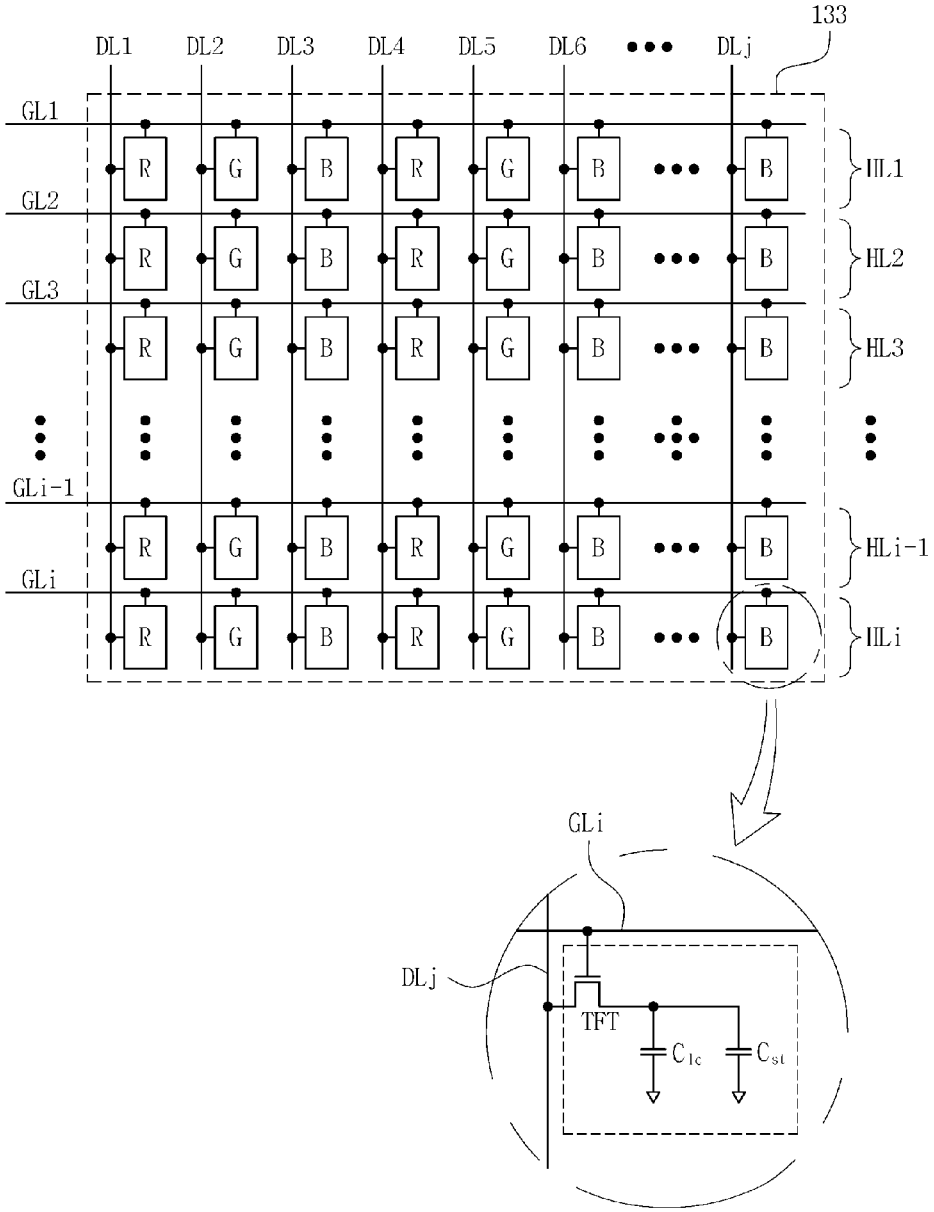
FIG. 2 is a view illustrating a configuration of a display panel of FIG. 1.

FIG. 1 is a block diagram illustrating a display device according to an exemplary embodiment. FIG. 2 is a view illustrating a configuration of a display panel 133 of FIG. 1.

Referring to FIG. 1, the display device includes the display panel 133, a backlight unit 150, a backlight controller 158, a timing controller 101, a gate driver 112, a data driver 111, a dimming signal generator 166, and a direct current-direct current ("DC-DC") converter 177.

The display panel 133 is configured to display an image. Although not illustrated, the display panel 133 includes a liquid crystal layer, and a lower substrate and an upper substrate facing one another while having the liquid crystal layer therebetween.

The lower substrate includes a plurality of gate lines GL1 to GLi, a plurality of data lines DL1 to DLj intersecting the gate lines GL1 to GLi, and thin film transistors TFT respectively connected to the gate lines GL1 to GLi and the data lines DL1 to DLj, disposed thereon.

Although not illustrated, the upper substrate includes a black matrix, a plurality of color filters, and a common electrode, disposed thereon. The black matrix is disposed on a portion of the upper surface, other than portions of the upper surface corresponding to pixel regions. The color filters are disposed in the respective pixel regions. In an exemplary embodiment, the color filters are divided into red color filters, green color filters, and blue color filters.

Pixels R, G, and B are arranged in a matrix form. The pixels R, G, and B are divided into red pixels R disposed corresponding to the red color filters, green pixels G disposed corresponding to the green color filters, and blue pixels B disposed corresponding to the blue color filters. In such an embodiment, horizontally adjacent red, green, and blue pixels R, G, and B may provide a unit pixel for displaying a unit image.

There are j pixels (j being a natural number) arranged along an n-th horizontal line (n being one of 1 to i). The j pixels are also referred to as "n-th horizontal line pixels", and may be respectively connected to the first to j-th data lines DL1 to DLj, respectively. In addition, the n-th horizontal line pixels are connected to a common n-th gate line. Accordingly, the n-th horizontal line pixels receive a common n-th gate signal. In other words, all the j pixels arranged along the same horizontal line receive the same gate signals while other pixels disposed on different horizontal lines receive different gate signals from one another. In an exemplary embodiment, a red pixel R and a green pixel G disposed on a first horizontal line HL1 all receive a first gate signal while a red pixel R and a green pixel G disposed on a second horizontal line HL2 all receive a second gate signal having a different timing from that of the first gate signal, for example.

As illustrated in FIG. 2, each of the red, green, and blue pixels R, G, and B includes a thin film transistor TFT, a liquid crystal capacitor Clc, and a storage capacitor Cst.

The thin film transistor TFT is turned on based on a gate signal from the gate line GL. The turned-on thin film transistor TFT supplies an analog image data signal supplied from the data line DL to the liquid crystal capacitor Clc and the storage capacitor Cst.

The liquid crystal capacitor Clc includes a pixel electrode and a common electrode disposed to oppose one another.

The storage capacitor Cst includes a pixel electrode and an opposing electrode disposed to oppose one another. In such an embodiment, the opposing electrode may be a previous gate line or a common line transmitting a common voltage.

Among the components constituting the pixels R, G, and B, the thin film transistor TFT is covered by the black matrix.

The timing controller 101 receives a vertical synchronization signal Vsync, a horizontal synchronization signal Hsync, an image data signal DATA, and a clock signal DCLK that are output from a graphic controller (not illustrated) provided in a system. An interface circuit (not illustrated) is provided between the timing controller 101 and the system, and the aforementioned signals output from the system are input to the timing controller 101 via the interface circuit. In an exemplary embodiment, the interface circuit may be embedded in the timing controller 101.

Although not illustrated, the interface circuit includes a low voltage differential signaling ("LVDS") receiver. The interface circuit lowers respective voltage levels of the vertical synchronization signal Vsync, the horizontal synchronization signal Hsync, the image data signal DATA, and the clock signal DCLK output from the system, and increases respective frequencies thereof.

Due to a high-frequency component of the signal input from the interface circuit to the timing controller 101, electromagnetic interference ("EMI") may occur between the interface circuit and the timing controller 101. In order to prevent EMI interference, an EMI filter (not illustrated) may further be provided between the interface circuit and the timing controller 101.

The timing controller 101 generates a gate control signal GCS for controlling the gate driver 112 and a data control signal DCS for controlling the data driver 111, based on the vertical synchronization signal Vsync, the horizontal synchronization signal Hsync, and the clock signal DCLK. In an exemplary embodiment, the gate control signal GCS includes a gate start pulse, a gate shift clock, a gate output enable signal, and the like. In an exemplary embodiment, the data control signal DCS includes a source start pulse, a source shift clock, a source output enable signal, a polarity signal, and the like.

Further, the timing controller 101 rearranges the image data signals DATA input through the system, and supplies the rearranged image data signals DATA' to the data driver 111.

The timing controller 101 may be operated by a driving power VCC output from a power unit provided in the system. In particular, the driving power VCC is used as a power voltage of a phase lock loop ("PLL") embedded in the timing controller 101. The PLL compares a frequency of the clock signal DCLK input to the timing controller 101 and a reference frequency generated by an oscillator. Based on the comparison results, in a case in which a difference is verified to be present between the compared frequencies, the PLL may adjust the frequency of the clock signal DCLK by the level corresponding to the difference to thereby generate a sampling clock signal. The sampling clock signal is a signal used to sample the image data signals DATA'.

The DC-DC converter 177 may increase or decrease the driving power VCC input through the system to thereby generate voltages required for the display panel 133. To this end, the DC-DC converter 177 may include, for example, an output switching element for switching an output voltage of an output terminal thereof, and a pulse width modulator ("PWM") for adjusting a duty ratio or a frequency of a control signal applied to a control terminal of the output switching element so as to increase or decrease the output voltage. In such an exemplary embodiment, the DC-DC converter 177 may include a pulse frequency modulator ("PFM"), in lieu of the pulse width modulator.

The pulse width modulator increases the duty ratio of the control signal to increase the output voltage of the DC-DC converter 177, or decreases the duty ratio of the control signal to lower the output voltage of the DC-DC converter 177. The pulse frequency modulator increases the frequency of the control signal to increase the output voltage of the DC-DC converter 177, or decreases the frequency of the control signal to lower the output voltage of the DC-DC converter 177. In an exemplary embodiment, the output voltage of the DC-DC converter 177 includes a reference voltage VDD of about 6 volts (V) or higher, a gamma reference voltage GMA1-10 of lower than level 10, a common voltage Vcom in a range of about 2.5 V to about 3.3 V, a gate high voltage VGH of about 15 V or higher, and a gate low voltage VGL of about −4 V or lower, for example.

The gamma reference voltage GMA1-10 is a voltage generated by voltage division of the reference voltage. The reference voltage and the gamma reference voltage are analog gamma voltages, and are provided to the data driver 111. The common voltage Vcom may be applied to the common electrode of the display panel 133 via the data driver 111. The gate high voltage VGH is a high logic voltage of the gate signal, which is set to be a threshold voltage of the thin film transistor TFT or higher. The gate low voltage VGL is a low logic voltage of the gate signal, which is set to be an off-voltage of the thin film transistor TFT. The gate high voltage VGH and the gate low voltage VGL are applied to the gate driver 112.

The gate driver 112 generates gate signals based on the gate control signal GCS applied from the timing controller 101, and sequentially applies the gate signals to the plurality of gate lines GL1 to GLi. In an exemplary embodiment, the gate driver 112 may include, for example, a shift register configured to shift the gate start pulse based on the gate shift clock to thereby generate the gate signals. The shift register may include a plurality of switching elements. The switching elements may be disposed on a front surface of the lower substrate in the same process as that forming the thin film transistor TFT in a display area.

The data driver 111 receives the image data signals DATA' and the data control signal DCS from the timing controller 101. The data driver 111 performs sampling of the image data signals DATA' based on the data control signal DCS, performs latching of the sampled image data signals corresponding to one horizontal line for each horizontal period, and applies the latched image data signals to the data lines DL1 to DLj. In other words, the data driver 111 converts the image data signals DATA' applied from the timing controller 101 into analog image data signals using the gamma reference voltages GMA1-10 input from the DC-DC converter 177, and supplies the analog image data signals to the data lines DL1 to DLj.

The dimming signal generator 166 receives the vertical synchronization signal Vsync, the horizontal synchronization signal Hsync, the image data signals DATA, and the clock signal DCLK output from the system. In such an exemplary embodiment, the dimming signal generator 166 receives the aforementioned signals via the interface circuit.

The dimming signal generator 166 divides image data signals in one frame into luminance components and chrominance components, analyzes the luminance components to calculate an average luminance with respect to image data in one frame, and generates a dimming signal based on the calculated average luminance. In an exemplary embodiment, in a case in which image data in one frame is a bright image having a high average luminance, a dimming signal having a high level to increase the luminance of the backlight unit 150 is generated, for example. In a case in which image data in one frame is a dark image having a low average luminance, a dimming signal having a low level to decrease the luminance of the backlight unit 150 is generated.

The backlight unit 150 is configured to supply light to the display panel 133. To this end, the backlight unit 150 includes a backlight 157 emitting light and the backlight controller 158 controlling the backlight 157.

Figure 3:
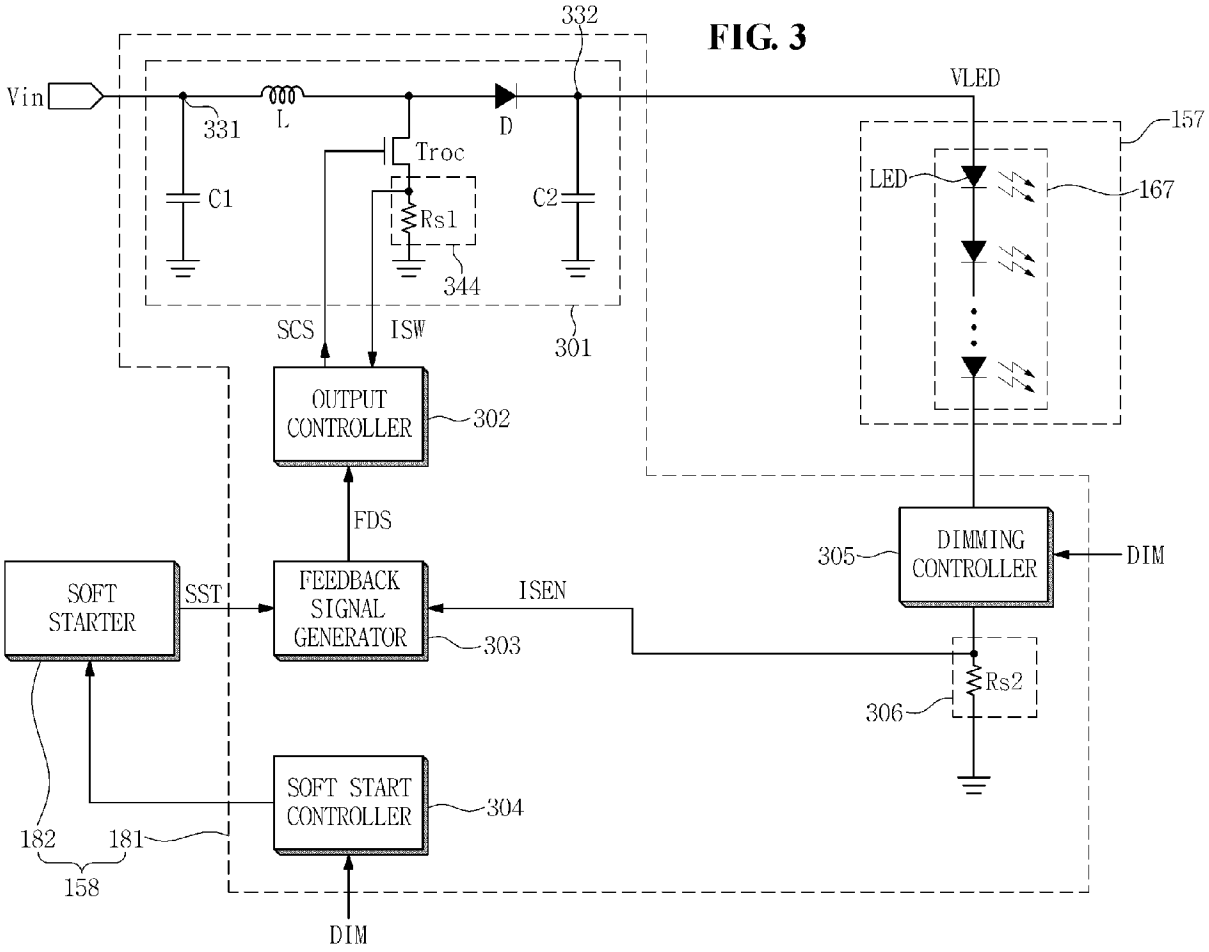
FIG. 3 is a view illustrating a configuration of a backlight and a backlight controller of FIG. 1.

FIG. 3 is a view illustrating a configuration of the backlight 157 and the backlight controller 158 of FIG. 1.

The backlight 157, as illustrated in FIG. 3, includes at least a light source unit 167. FIG. 3 illustrates an example in which the backlight 157 includes one light source unit 167. In a case in which the backlight 157 includes two or more light source units 167, the light source units 167 are connected to a power converter 301 in parallel.

The light source unit 167 includes at least a light source LED. The light source LED receives a light source driving current generated based on a light source driving voltage VLED from the backlight controller 158. The light source LED emits light by the light source driving current. When the light source unit 167 includes a plurality of light sources LEDs, the light source LEDs are connected in series between the power converter 301 and the dimming controller 305.

In an exemplary embodiment, the light source LED may be a light emitting package including at least a light emitting diode ("LED"). In an exemplary embodiment, one light emitting package may include therein a red light emitting diode which emits a red light, a green light emitting diode which emits a green light, and a blue light emitting diode which emits a blue light, for example. The light emitting package generates a white light by mixing lights having the three colors. In an alternative exemplary embodiment, the light emitting package only includes a blue light emitting diode among the red, green, and blue light emitting diodes. In this case, a phosphor for converting a blue light into a white light is provided in a light emitting portion of the blue light emitting diode.

In an exemplary embodiment, the light source LED may also use a laser diode or a carbon nanotube ("CNT"), in lieu of the light emitting diode, for example.

In an exemplary embodiment, the backlight 157 may be one of a direct-type backlight, an edge-type backlight, and a corner-type backlight, for example.

The backlight controller 158 generates the light source driving voltage VLED for emitting the light source LED. In addition, the backlight controller 158 controls the light source driving current flowing in the light source LED by adjusting the light source driving voltage VLED flowing in the light source LED.

The backlight controller 158, as illustrated in FIG. 3, includes a light source controller 181 and a soft starter 182.

The light source controller 181 controls the light source driving voltage VLED based on a soft start voltage SST from the soft starter 182.

The light source controller 181 includes a driving current detector 306, a dimming controller 305, a soft start controller 304, a feedback signal generator 303, an output controller 302, and the power converter 301.

The power converter 301 converts an externally applied input voltage Vin into the light source driving voltage VLED.

The power converter 301 includes an inductor L, a diode D, an input capacitor C1, an output capacitor C2, an output control switching element Troc, and a switching current detector 344.

The inductor L and the diode D are connected between an input terminal 331 and an output terminal 332 of the power converter 301.

The input capacitor C1 is connected between the input terminal 331 of the power converter 301 and ground.

The output capacitor C2 is connected between the output terminal 332 of the power converter 301 and ground.

The output control switching element Troc is controlled based on a switch control signal SCS from the output controller 302, and is connected between an anode electrode of the diode D and the switching current detector 344.

The switching current detector 344 detects a switching current flowing through the output control switching element Troc, and generates a detection voltage ISW corresponding to the detected switching current. To this end, the switching current detector 344 may include a detection resistor Rs1, and the detection resistor Rs1 may be connected between the output control switching element Troc and ground. The detection voltage ISW is a voltage across opposite ends of the detection resistor Rs1. The detection voltage ISW generated by the switching current detector 344 is supplied to the output controller 302.

The power converter 301 having such a configuration converts the externally applied input voltage Vin into the light source driving voltage VLED, and outputs the light source driving voltage VLED. In such an exemplary embodiment, the level of the light source driving voltage VLED is adjusted by the switch control signal SCS. In an exemplary embodiment, as a duty ratio of the switch control signal SCS increases, the level of the light source driving voltage VLED increases, for example. The light source driving voltage VLED generated from the power converter 301 is applied to the light source LED through the output terminal 332.

The driving current detector 306 detects the light source driving current supplied to the light source LED and generates a detection voltage ISEN. The driving current detector 306 is connected between the dimming controller 305 and ground.

The dimming controller 305 controls the light source driving current based on an externally applied dimming control signal DIM. The dimming control signal DIM may be supplied from the dimming signal generator 166 (refer to FIG. 1). Although not illustrated, the dimming controller 305 may include a balance switching element. The balance switching element may be controlled based on the dimming control signal DIM, and may be connected between the light source unit 167 and the driving current detector 306. The balance switching element may be turned on during a duty-on period of the dimming control signal DIM, and may be turned off during a duty-off period of the dimming control signal DIM. In other words, the light source LED is emitted during a period corresponding to the duty-on period of the dimming control signal DIM whereas the light source LED is turned off during a period corresponding to the duty-off period of the dimming control signal DIM. In this manner, a light emission period of time of the light source LED is adjusted based on a duty ratio of the dimming control signal DIM to thereby adjust an amount of light generated from the light source LED. Accordingly, the luminance of the light source LED may be controlled by the duty ratio of the dimming control signal DIM.

The driving current detector 306 detects the light source driving current flowing through the light source LED and the turned-on balance switching element of the dimming controller 305, and generates the detection voltage ISEN corresponding to the detected light source driving current. To this end, the driving current detector 306 may include a detection resistor Rs2, and the detection resistor Rs2 may be connected between the balance switching element and ground. The detection voltage ISEN is a voltage across opposite ends of the detection resistor Rs2. The detection voltage ISEN generated by the driving current detector 306 is supplied to the feedback generator 303. In an exemplary embodiment, the detection voltage ISEN from the driving current detector 306 may further be supplied to the dimming controller 305. Accordingly, the dimming controller 305 may compare the detection voltage ISEN and a predetermined reference voltage using a comparator in the dimming controller 305 and may control the balance switching element based on the comparison results, to thereby allow the light source driving current flowing through the light source LED to have a predetermined level.

The feedback signal generator 303 generates a feedback signal FDS based on the soft start voltage SST from the soft starter 182 and the detection voltage ISEN from the driving current detector 306.

The output controller 302 generates the switch control signal SCS based on the feedback signal FDS from the feedback signal generator 303. The switch control signal SCS from the output controller 302 is input to the power converter 301. The output controller 302 may further receive the detection voltage ISW from the switching current detector 344. In this case, the output controller 302 generates the switch control signal SCS based on the feedback signal FDS and the detection signal ISW.

The soft start controller 304 controls the soft starter 182 based on the dimming control signal DIM from the dimming signal generator 166 (refer to FIG. 1). In an exemplary embodiment, the soft start controller 304 charges a soft start capacitor during the duty-on period of the dimming control signal DIM, for example. The soft start controller 304 does not charge the soft start capacitor during the duty-off period of the dimming control signal DIM. To this end, the soft start controller 304 may include a current source. The current source is electrically connected to the soft starter 182 during the duty-on period of the dimming control signal DIM, and is electrically separated from the soft starter 182 during the duty-off period of the dimming control signal DIM. When the current source and the soft starter 182 are electrically connected, the soft start capacitor is charged by a charge signal from the current source. When the electric connection between the current source and the soft starter 182 is cut off, the charge stored in the soft start capacitor begins to be discharged. In an exemplary embodiment, the charge signal from the current source may be a current. In an exemplary embodiment, the soft start controller 182 may include a voltage source in lieu of the current source. In this case, the charge signal may be a voltage.

In this manner, the level of the soft start voltage SST may vary as the soft start controller 304 charges and discharges the soft start capacitor based on the dimming control signal DIM. In an exemplary embodiment, when the soft start capacitor is discharged, the level of the soft start voltage SST decreases, for example. Accordingly, when the level of the soft start voltage SST decreases, the level of the feedback signal FDS generated based on the level of the soft start voltage SST also decreases, such that the duty ratio of the switch control signal SCS output from the output controller 302 decreases. Thus, the level of the light source driving voltage VLED output from the power converter 301 decreases so as to lower the level of the light source driving current applied to the light source LED. As a result, the overshoot of the light source driving current may be prevented.

The soft starter 182 generates the soft start voltage SST based on an externally applied charge signal. The soft starter 182 discharges the soft start voltage SST when the charge signal is not applied thereto. In an exemplary embodiment, the soft starter 182 generates a first soft start voltage by receiving a charge signal from the light source controller 181, and generates a second soft start voltage having a level lower than the level of the first soft start voltage when the charge signal is not applied thereto, for example. The soft start voltage from the soft starter 182 is supplied to the light source controller 181. To this end, the soft starter 182 is connected to an input terminal of the light source controller 181.

Figure 4:
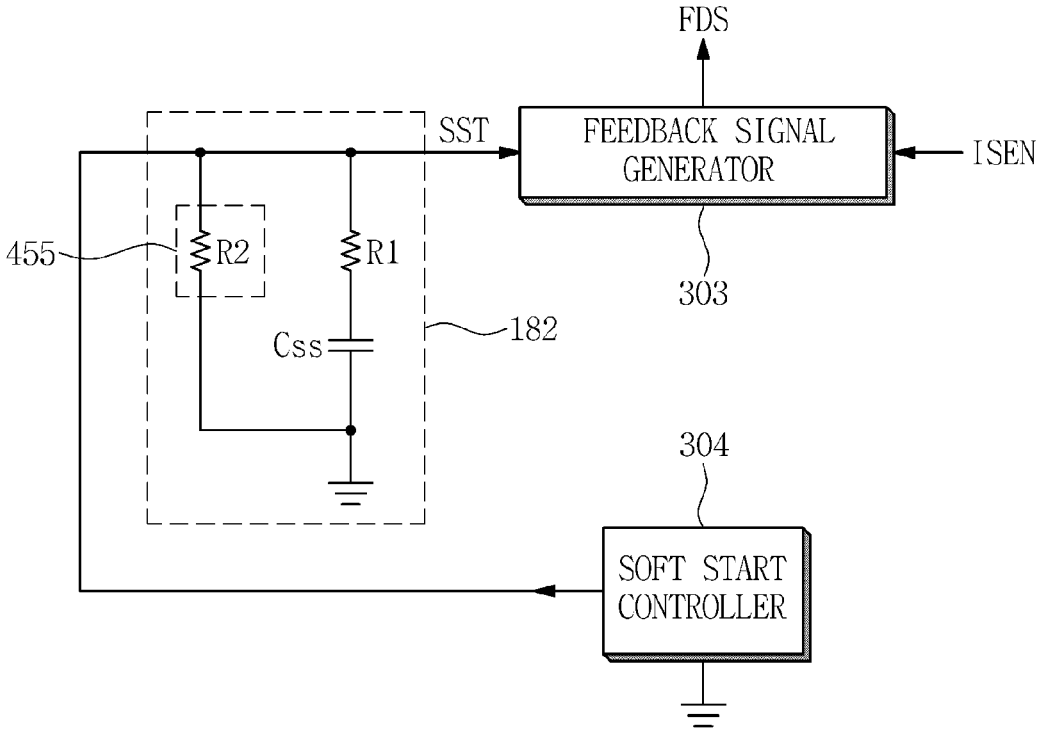
FIG. 4 is a view illustrating a configuration of a soft starter of FIG. 3.

FIG. 4 is a view illustrating a configuration of the soft starter 182 of FIG. 3.

The soft starter 182, as illustrated in FIG. 4, includes a resistor R1, an electric element 455, and a soft start capacitor Css.

One end terminal of the resistor R1 is connected to the input terminal of the light source controller 181, and the input terminal of the light source controller 181 corresponds to an input terminal of the feedback signal generator 303. In other words, the aforementioned input terminal corresponds to the input terminal of the light source controller 181 to which the soft start voltage SST is applied.

The soft start capacitor Css is connected between another end terminal of the resistor R1 and ground.

The electric element 455 is connected between the input terminal of the light source controller 181 and ground. The electric element 455 is a resistive element, and may include, for example, at least one of a resistor, an inductor, a capacitor, and a switching element. FIG. 4 illustrates an example in which the electric element 455 includes a single resistor R2, and the resistor R2 is connected between the input terminal of the light source controller 181 and ground. In a case in which the electric element 455 includes a switching element, the switching element may have a diode form, for example. In an exemplary embodiment, the switching element may include a gate electrode connected to the input terminal of the light source controller 181, a drain electrode connected to the input terminal of the light source controller 181, and a source electrode connected to ground, for example. In an alternative exemplary embodiment, the switching element may include a gate electrode to which a predetermined DC voltage is applied, a drain electrode connected to the input terminal of the light source controller 181, and a source electrode connected to ground. In such an exemplary embodiment, the predetermined DC voltage may be a voltage having a level higher than the level of a threshold voltage of the switching element.

An electric connection between the soft start controller 304 and the soft starter 182 is cut off during the duty-off period of the dimming control signal DIM, despite the disconnection therebetween, the soft start capacitor Css and ground provide a closed circuit by the electric element 455, such that the soft start capacitor Css may be rapidly discharged. Accordingly, a period of time to charge the soft start capacitor Css increases during the duty-on period of the dimming control signal DIM. In an exemplary embodiment, the soft start capacitor Css may not be fully charged during the duty-on period, for example. Accordingly, a charge rate of the soft start capacitor Css decreases during the duty-on period of the dimming control signal DIM, such that the level of the soft start voltage SST generated during the duty-on period may be relatively low. Thus, as described above, the duty ratio of the switch control signal SCS decreases, whereby the overshoot of the light source driving current may be prevented.

Figure 5:
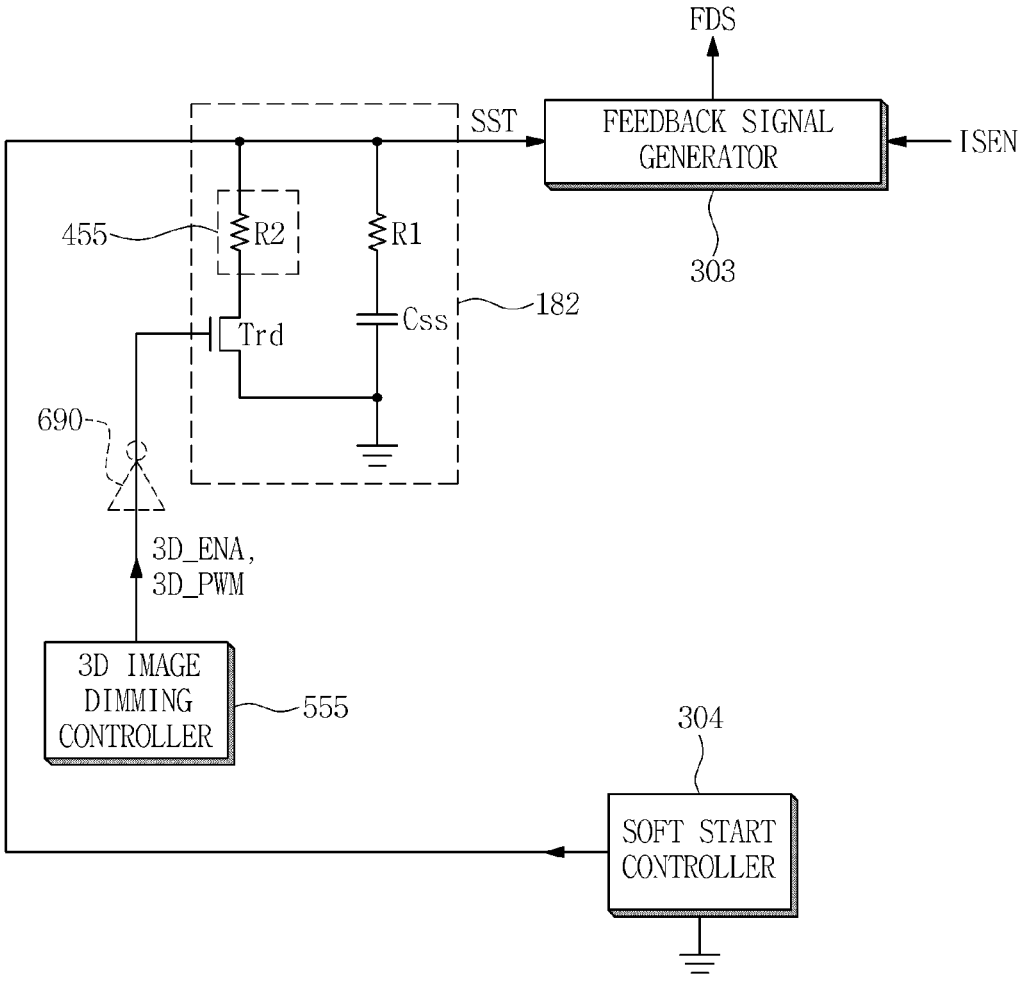
FIG. 5 is a view illustrating another configuration of a soft starter of FIG. 3.
Figure 6:
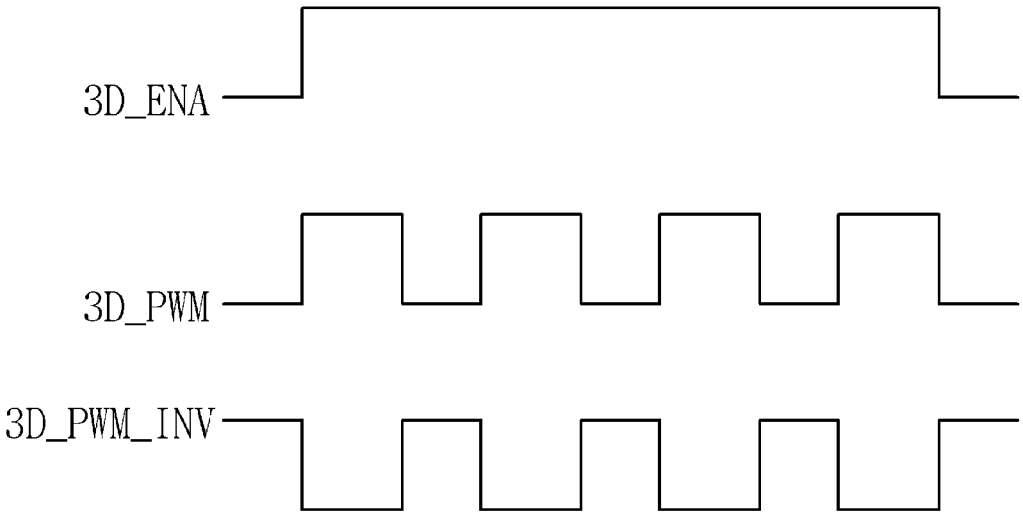
FIG. 6 is a view illustrating waveforms of a three-dimensional ("3D") image dimming enable signal, a 3D image dimming pulse width modulation ("PWM") signal, and an inverted 3D image dimming PWM signal.

FIG. 5 is a view illustrating another configuration of the soft starter 182 of FIG. 3. FIG. 6 is a view illustrating waveforms of a three-dimensional ("3D") image dimming enable signal 3D_ENA, a 3D image dimming pulse width modulation ("PWM") signal 3D_PWM, and an inverted 3D image dimming PWM signal 3D_PWM_INV.

The soft starter 182, as illustrated in FIG. 5, includes a resistor R1, an electric element 455, a soft start capacitor Css, and a discharge switching element Trd.

Since the resistor R1 and the soft start capacitor Css of FIG. 5 are the same as those described with reference to FIG. 4, the repeated description thereof will make reference to analogous features in FIG. 4 and the like.

The discharge switching element Trd is controlled based on an externally applied discharge control signal, and is connected between the electric element 455 and ground.

The discharge switching element Trd may be controlled by a 3D image dimming controller 555.

The 3D image dimming controller 555, as illustrated in FIG. 5, generates at least one of a 3D image dimming enable signal 3D_ENA and a 3D image dimming PWM signal 3D_PWM, and supplies the at least one of the signals to the light source controller 181.

The 3D image dimming enable signal 3D_ENA and the 3D image dimming PWM signal 3D_PWM control the light source controller 181 so as to allow light having a suitable luminance for displaying a 3D stereoscopic image to be emitted to the light source. In such an exemplary embodiment, the 3D image dimming PWM signal 3D_PWM may have a constant duty ratio, for example, a duty ratio of about 56%, for example.

One of the 3D image dimming enable signal 3D_ENA and the 3D image dimming PWM signal 3D_PWM may be used as a discharge control signal. However, the 3D image dimming PWM signal 3D_PWM needs to have an inverted form in order to be used as a discharge control signal. To this end, an inverter 690 may further be connected between the 3D image dimming controller 555 and the discharge switching element Trd. The inverter 690 may invert the 3D image dimming PWM signal 3D_PWM from the 3D image dimming controller 555. In an alternative exemplary embodiment, in a case in which the 3D image dimming controller 555 further outputs an inverted 3D image dimming PWM signal 3D_PWM_INV, aside from the 3D image dimming PWM signal 3D_PWM, the inverter 690 may not be used.

The discharge switching element Trd is turned on by the 3D image dimming enable signal 3D_ENA as illustrated in FIG. 6. The soft start capacitor Css and ground may provide a closed circuit by the turned-on discharge switching element Trd.

When the display device displays a general two-dimensional ("2D") image rather than a stereoscopic image, the 3D image dimming controller 555 outputs an off-voltage in lieu of the 3D image dimming enable signal 3D_ENA. The discharge switching element Trd is turned off by the off-voltage. When the discharge switching element Trd is turned off, the soft start capacitor Css and ground may not provide a closed circuit. Accordingly, the soft start capacitor Css may not be discharged.

In addition, the discharge switching element Trd is turned on by the inverted 3D image dimming PWM signal 3D_PWM_INV as illustrated in FIG. 6. In an exemplary embodiment, the discharge switching element Trd is turned on during a duty-on period of the inverted 3D image dimming PWM signal 3D_PWM_INV, for example. The soft start capacitor Css and ground may provide a closed circuit by the turned-on discharge switching element Trd.

When the display device displays a general 2D image rather than a stereoscopic image, the 3D image dimming controller 555 outputs an off-voltage in lieu of the 3D image dimming PWM signal 3D_PWM.

The discharge switching element Trd may be controlled by a discharge controller rather than by the 3D image dimming controller 555. A description pertaining to the discharge controller will be provided in greater detail hereinbelow with reference to FIGS. 7 and 8.

Figure 7:
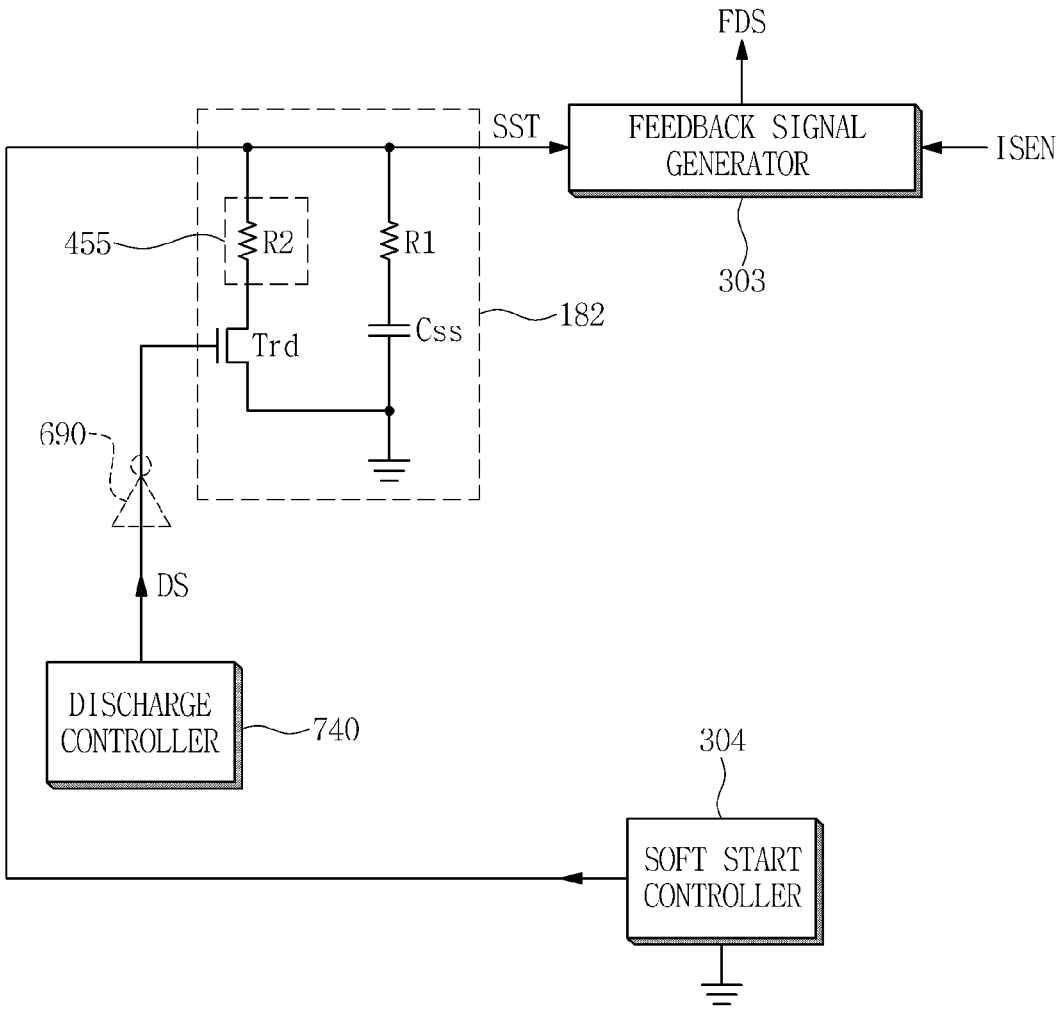
FIG. 7 is a view illustrating another configuration of a soft starter of FIG. 3.
Figure 8:
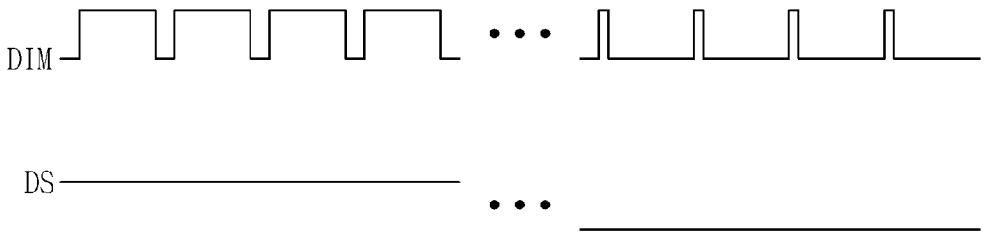
FIG. 8 is a view illustrating a waveform of a discharge control signal.

FIG. 7 is a view illustrating another configuration of the soft starter 182 of FIG. 3. FIG. 8 is a view illustrating a waveform of a discharge control signal DS.

The soft starter 182, as illustrated in FIG. 7, includes a resistor R1, an electric element 455, a soft start capacitor Css, and a discharge switching element Trd.

Since the resistor R1 and the soft start capacitor Css of FIG. 7 are the same as those described with reference to FIG. 4, the repeated description thereof will make reference to analogous features in FIG. 4 and the like.

The discharge switching element Trd is controlled based on a discharge control signal DS from a discharge controller 740, and is connected between the electric element 455 and ground.

The discharge controller 740 determines whether to output the discharge control signal DS based on the duty ratio of the dimming control signal DIM (refer to FIG. 3) supplied from the dimming signal generator 166 (refer to FIG. 1). In an exemplary embodiment, the discharge controller 740, as illustrated in FIG. 8, outputs the discharge control signal DS when the duty ratio of the dimming control signal DIM is high, and outputs an off-voltage when the duty ratio of the dimming control signal DIM is low, for example. In an exemplary embodiment, when the duty ratio of the dimming control signal DIM is higher than a predetermined reference duty ratio, the discharge controller 740 outputs the discharge control signal DS, and when the duty ratio of the dimming control signal DIM is equal to or lower than the reference duty ratio, the discharge controller 740 outputs the off-voltage, for example.

The discharge switching element Trd is turned on by the discharge control signal DS. The soft start capacitor Css and ground may provide a closed circuit by the turned-on discharge switching element Trd. The discharge switching element Trd is turned off by the off-voltage.

The structure of FIG. 7 may address issues that arise when the light source driving current is controlled by the dimming control signal DIM having a low duty ratio. In other words, in the case in which the dimming control signal DIM has a significantly low duty ratio, when the soft start capacitor Css is discharged, the light source driving current may not be generated in a normal manner. When the duty ratio of the dimming control signal DIM is lower than the reference duty ratio, the structure of FIG. 7 may maintain a charged state of the soft start capacitor Css by turning on the discharge switching element Trd.

The discharge switching element Trd may be connected to an input terminal of the dimming controller 305. A description pertaining thereto will be provided in greater detail hereinbelow with reference to FIG. 9.

Figure 9:
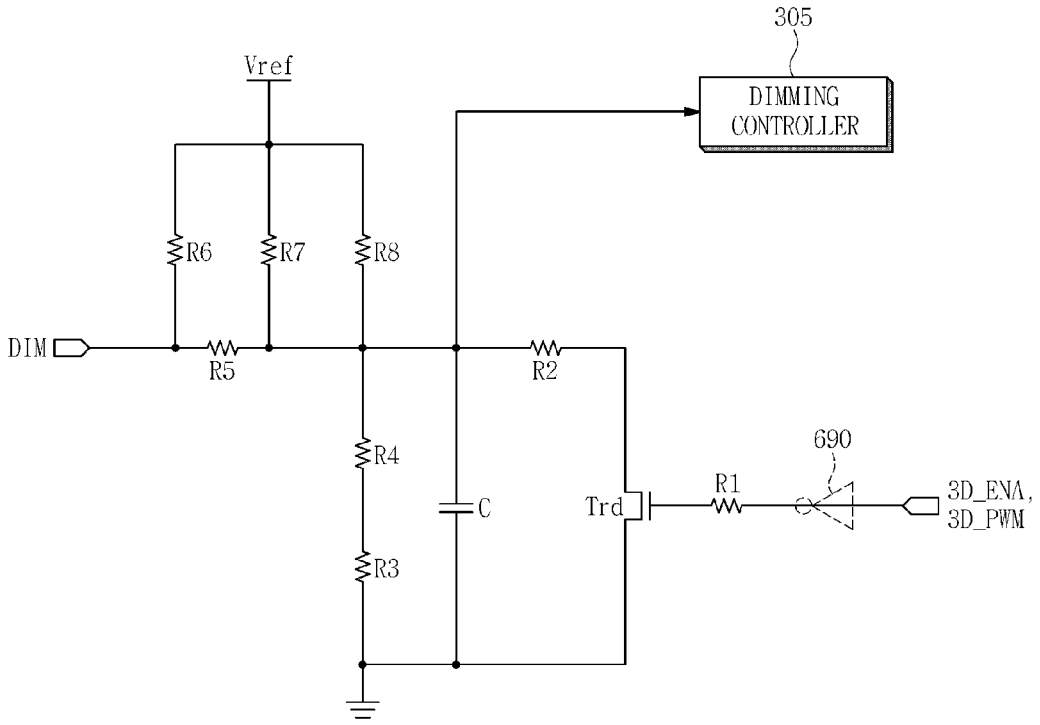
FIG. 9 is a view illustrating a discharge switching element connected to a dimming controller of FIG. 3.

FIG. 9 is a view illustrating the discharge switching element Trd connected to the dimming controller 305 of FIG. 3.

The dimming control signal DIM is supplied to the dimming controller 305 through the input terminal of the dimming controller 305. In such an exemplary embodiment, the dimming control signal DIM is an analog signal.

A plurality of resistors R2 to R8 and a capacitor C are connected to the input terminal of the dimming controller 305. The capacitor C is connected between the input terminal of the dimming controller 305 and ground.

The discharge switching element Trd is connected between the input terminal of the dimming controller 305 and ground. In such an exemplary embodiment, a drain electrode of the discharge switching element Trd is connected to the input terminal of the dimming controller 305 through the resistor R2.

The discharge switching element Trd may receive the 3D image dimming enable signal 3D_ENA or the inverted 3D image dimming PWM signal 3D_PWM_INV. The 3D image dimming enable signal 3D_ENA or the inverted 3D image dimming PWM signal 3D_PWM_INV is applied to a gate electrode of the discharge switching element Trd through the resistor R1.

When the discharge switching element Trd is turned on, the capacitor C is rapidly discharged. Accordingly, the level of the analog dimming control signal DIM decreases. The analog dimming control signal DIM is converted into a digital dimming control signal by the dimming controller 305 to thereby be applied to the balance switching element. In such an exemplary embodiment, since the level of the analog dimming control signal DIM is relatively low, the digital dimming control signal that is converted based on the relatively low level of the dimming control signal DIM has a relatively low duty ratio. Thus, since the balance switching element is controlled by the digital dimming control signal having such a low duty ratio, the overshoot of the light source driving current flowing through the balance switching element may be prevented.

Figure 10:
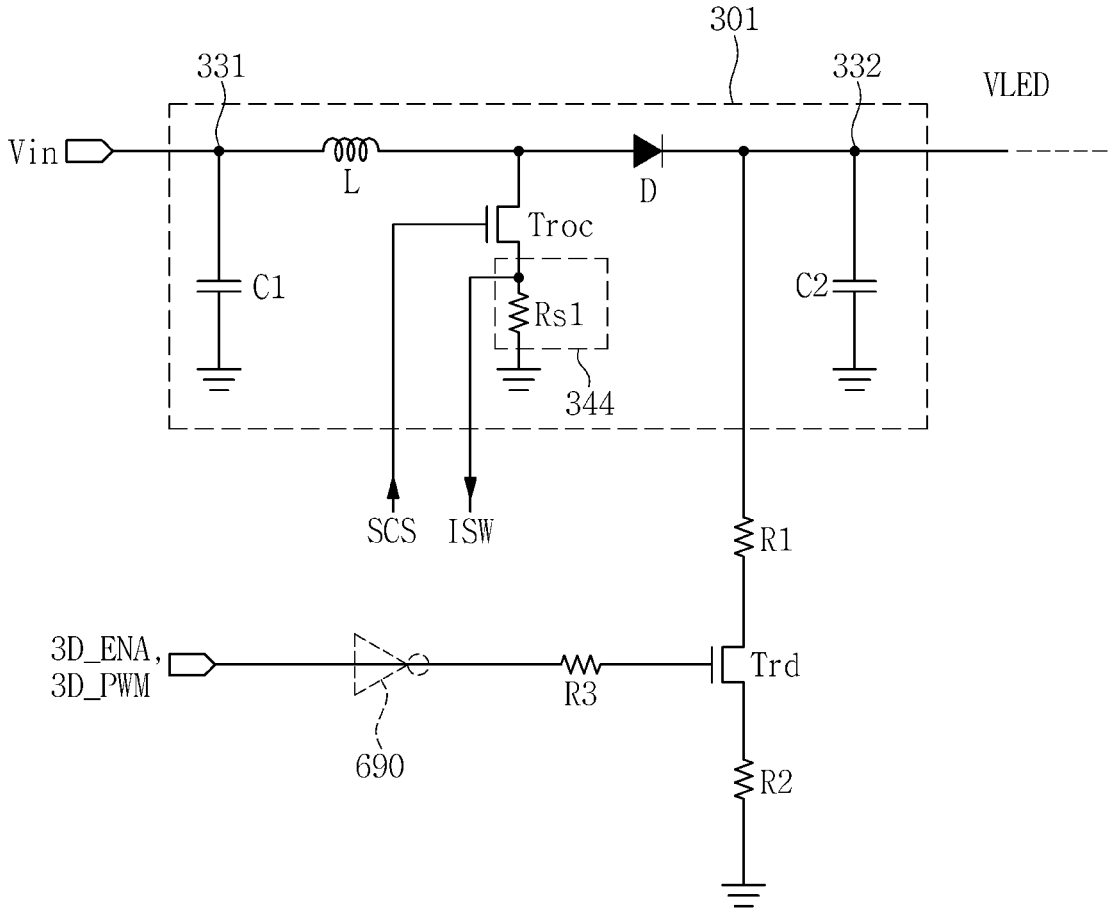
FIG. 10 is a view illustrating a discharge switching element connected to a power converter of FIG. 3.

The discharge switching element Trd may be connected to the output terminal 332 (refer to FIG. 10) of the power converter 301 (refer to FIG. 10). A description pertaining thereto will be provided in greater detail hereinbelow with reference to FIG. 10.

FIG. 10 is a view illustrating the discharge switching element Trd connected to the power converter 301 of FIG. 3.

The discharge switching element Trd is connected between the output terminal 332 of the power converter 301 and ground. In such an exemplary embodiment, the drain electrode of the discharge switching element Trd is connected to the output terminal 332 of the power converter 301 through the resistor R1, and a source electrode is connected to ground through the resistor R2.

The discharge switching element Trd may receive the 3D image dimming enable signal 3D_ENA or the inverted 3D image dimming PWM signal 3D_PWM_INV. The 3D image dimming enable signal 3D_ENA or the inverted 3D image dimming PWM signal 3D_PWM_INV is applied to the gate electrode of the discharge switching element Trd through the resistor R3.

When the discharge switching element Trd is turned on, an output capacitor C2 is rapidly discharged. Accordingly, the level of the light source driving voltage VLED decreases. Thus, the level of the light source driving current generated based on the light source driving voltage VLED decreases, such that the overshoot of the light source driving current may be prevented.

Figure 11:
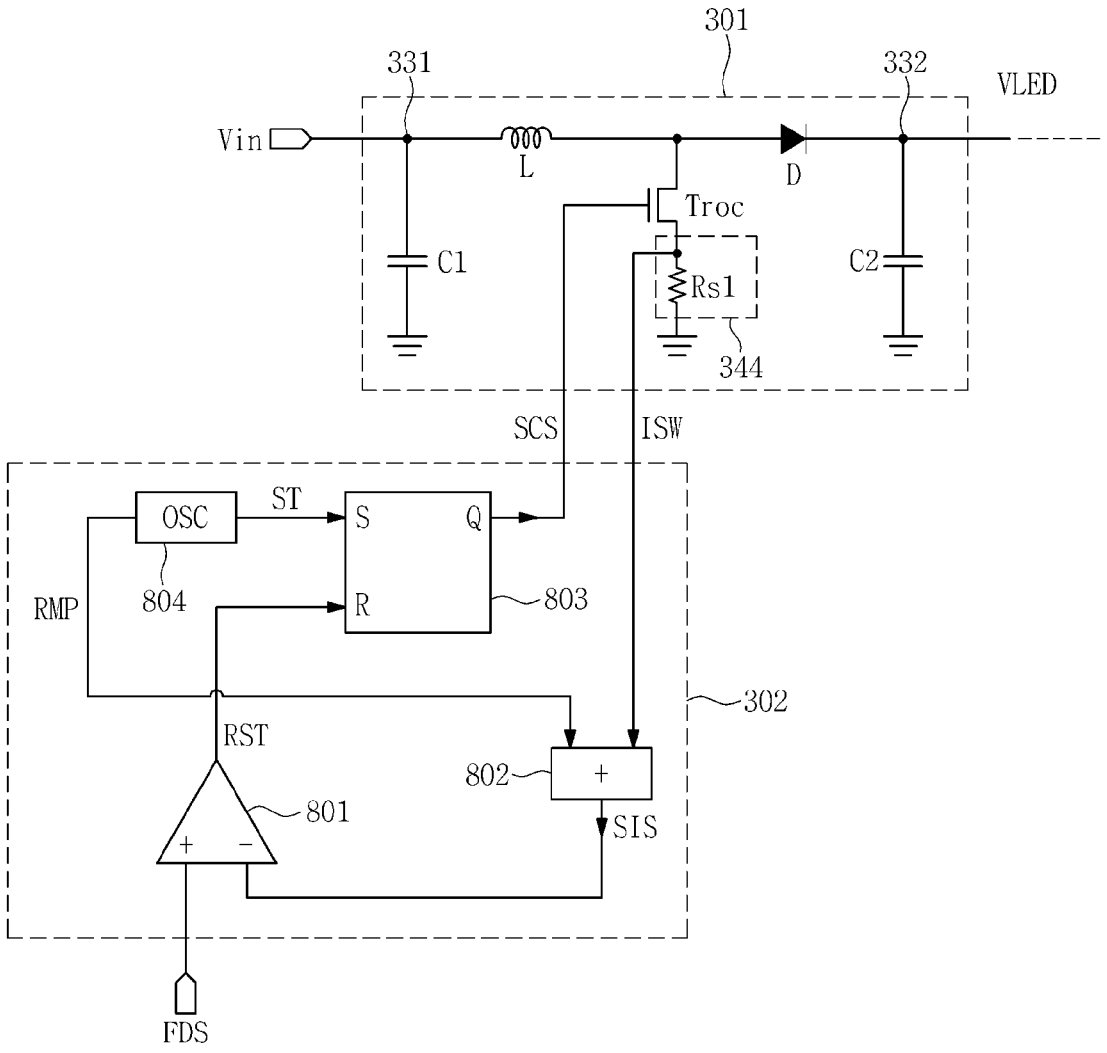
FIG. 11 is a view illustrating a configuration of an output controller of FIG. 3.
Figure 12:
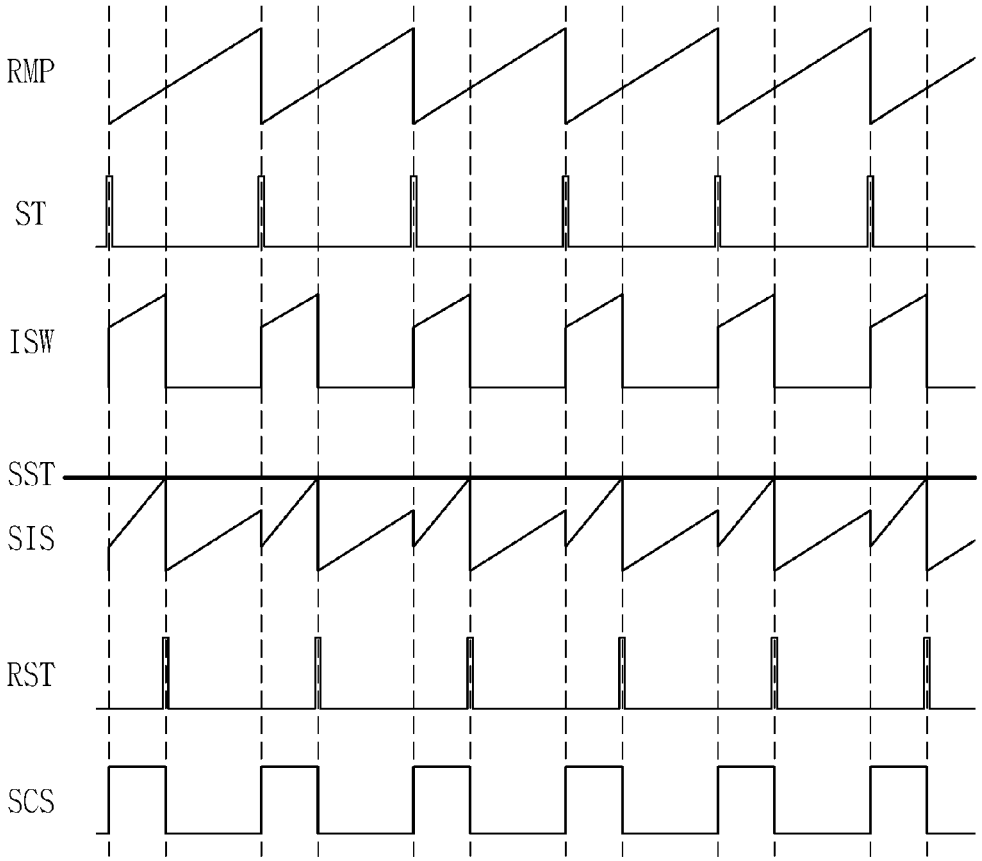
FIG. 12 is a view illustrating waveforms of a ramp signal, a set signal, a detection voltage, a soft start voltage, a synthetized signal, a reset signal, and a switch control signal.

FIG. 11 is a view illustrating a configuration of the output controller 302 of FIG. 3. FIG. 12 is a view illustrating waveforms of a ramp signal RMP, a set signal ST, a detection voltage ISW, a soft start voltage SST, a synthesized signal SIS, a reset signal RST, and a switch control signal SCS.

The output controller 302, as illustrated in FIG. 11, includes a comparator 801, an adder 802, an oscillator OSC, and a latch 803.

The oscillator OSC generates a ramp signal RMP and a set signal ST as illustrated in FIG. 12.

The adder 802 generates a synthesized signal SIS as illustrated in FIG. 12 by adding the ramp signal RMP from the oscillator OSC and the detection voltage ISW from the power converter 301. The ramp signal RMP and the detection voltage ISW are added during the duty-on period of the switch control signal SCS, whereby a synthesized signal SIS having a greater inclination than that of the ramp signal RMP is output. A synthesized signal SIS having the same inclination as that of the ramp signal RMP is output during the duty-off period of the switch control signal SCS.

The comparator 801 compares the feedback signal FDS from the feedback signal generator 303 and the synthesized signal SIS from the adder 802, and outputs a reset signal RST. The level of the feedback signal FDS varies based on the level of the soft start voltage SST. In an exemplary embodiment, as the level of the soft start voltage SST increases, the level of the feedback signal FDS increases, for example. The comparator 801 outputs a high voltage when the synthesized signal SIS is higher than or equal to the feedback signal FDS, and outputs a low voltage when the synthesized signal SIS is lower than the feedback signal FDS. Accordingly, the reset signal RST may have a form as illustrated in FIG. 12.

The latch 803 is set by the set signal ST from the oscillator OSC, and is reset by the reset signal RST from the comparator 801. The latch 803 generates a switch control signal SCS that is maintained at a high voltage from a rising edge point in time of the set signal ST and is maintained at a low voltage from a rising edge point in time of the rest signal RST. The switch control signal SCS from the latch 803 is applied to a gate electrode of an output control switching element Troc.

A duty ratio of the switch control signal SCS varies by the soft start voltage SST. In an exemplary embodiment, when the soft start voltage SST (refer to FIG. 3) increases, the feedback signal FDS increases, for example. Accordingly, the rising edge point in time of the reset signal RST is delayed, and thus, the duty ratio of the switch control signal SCS increases. When the soft start voltage SST decreases, the feedback signal FDS decreases. Accordingly, the rising edge point in time of the reset signal RST is advanced, and thus, the duty ratio of the switch control signal SCS decreases.

Figure 13A:
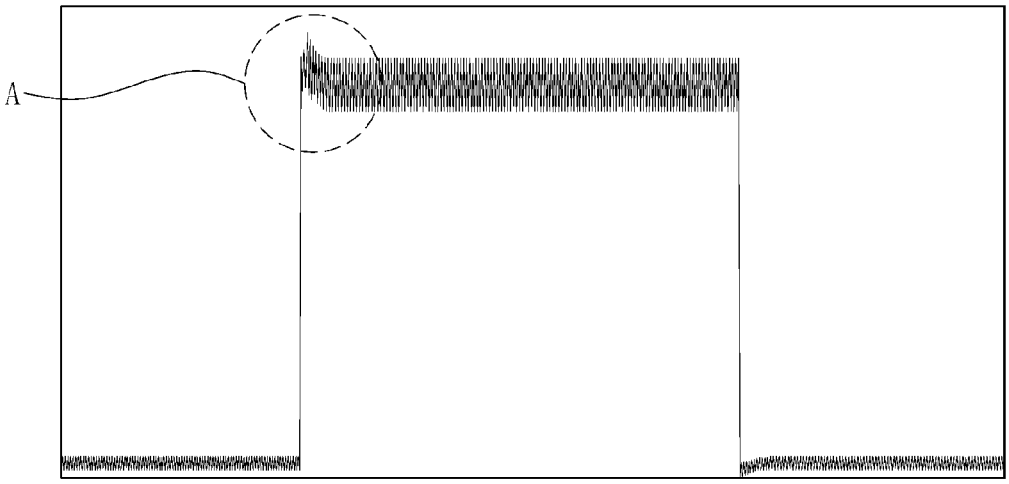
FIGS. 13A and 13B are views illustrating waveforms of light source driving currents.
Figure 13B:
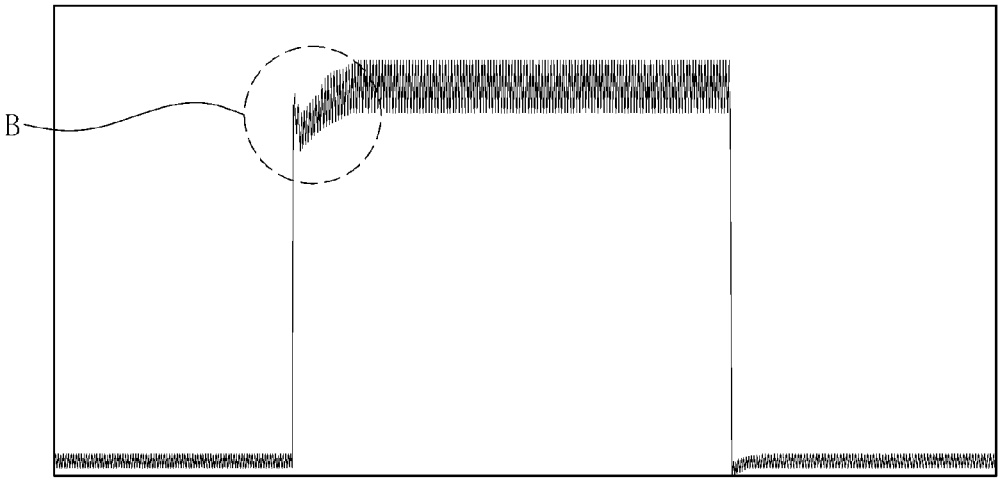

FIGS. 13A and 13B are views illustrating waveforms of light source driving currents. FIG. 13A illustrates a waveform of a light source driving current generated from a conventional backlight unit. FIG. 13B illustrates a waveform of a light source driving current generated from the backlight unit 150 according to the exemplary embodiment.

The light source driving current generated from the conventional backlight unit has an overshoot waveform A at a rising edge point in time as illustrated in FIG. 13A. The light source driving current generated from the backlight unit 150 according to the exemplary embodiment has a normal waveform B at a rising edge point in time as illustrated in FIG. 13B.

Figure 14:
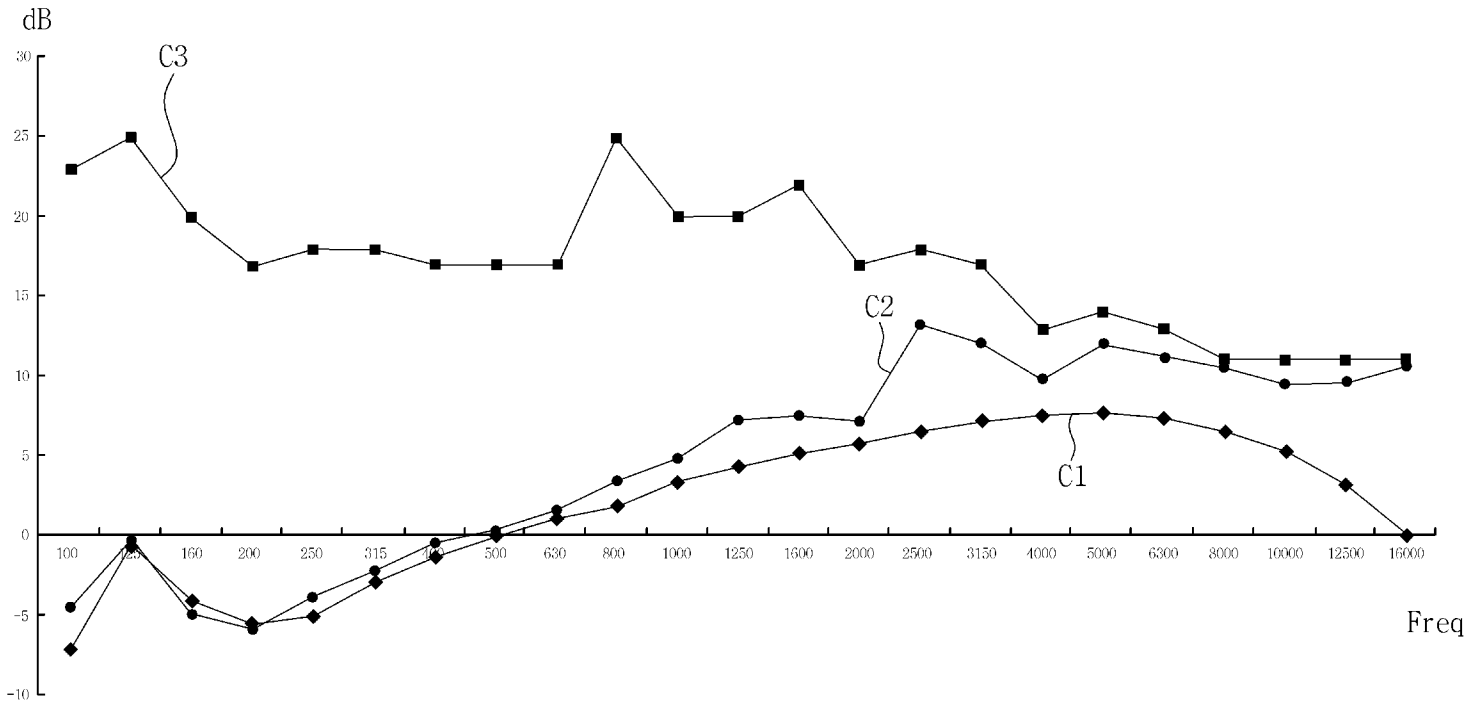
FIG. 14 is a set of graphs illustrating a magnitude of audible noise based on a driving frequency of a backlight unit according to an exemplary embodiment.

FIG. 14 is a set of graphs illustrating a magnitude of audible noise based on a driving frequency of the backlight unit 150 according to the exemplary embodiment.

A first curved graph C1 represents a magnitude of base noise, and more particularly, a magnitude of noise generated from a liquid crystal display ("LCD") device including a backlight unit. A third curved graph C3 represents reference noise, and more particularly, a tolerance limit of audible noise generated from a backlight unit.

A second curved graph C2 represents a magnitude of audible noise generated from the backlight unit 150 according to the exemplary embodiment. As illustrated in FIG. 14, the audible noise of the backlight unit 150 according to the exemplary embodiment has a magnitude less than the tolerance limit in all driving frequencies.

As set forth above, according to at least one exemplary embodiment, the backlight unit may significantly reduce the overshoot of the light source driving current by discharging the soft start voltage based on the dimming control signal. Accordingly, the audible noise of the backlight unit may be reduced.

From the foregoing, it will be appreciated that various exemplary embodiments in accordance with the invention have been described herein for purposes of illustration, and that various modifications may be made without departing from the scope and spirit of the teachings. Accordingly, the various exemplary embodiments disclosed herein are not intended to be limiting of the true scope and spirit of the teachings. Various features of the above described and other exemplary embodiments can be mixed and matched in any manner, to produce further exemplary embodiments consistent with the invention.

What is claimed is:

1. A backlight unit comprising:

a light source driven by a light source driving voltage;

a light source controller which controls the light source driving voltage; and a soft starter which generates a first soft start voltage by receiving a charge signal from the light source controller and outputs the first soft start voltage to the light source controller, generates a second soft start voltage having a level lower than the level of the first soft start voltage when the charge signal is not applied thereto and outputs the second soft start voltage to the light source controller, wherein the soft starter comprises:

a soft start capacitor connected between an input terminal of the light source controller and ground; and an electric element connected between the input terminal of the light source controller and the ground.

2. The backlight unit of claim 1, wherein the electric element comprises at least one of a resistor, an inductor, a capacitor, and a switching element.

3. The backlight unit of claim 1, wherein the soft starter further comprises a resistor connected between the input terminal of the light source controller and the soft start capacitor.

4. The backlight unit of claim 1, wherein the soft starter further comprises a discharge switching element controlled based on an externally applied discharge control signal, the discharge switching element connected between the electric element and the ground.

5. The backlight unit of claim 4, further comprising a three-dimensional image dimming controller which outputs, as the discharge control signal, one of a three-dimensional image dimming enable signal and an inverted three-dimensional image dimming pulse width modulation signal.

6. The backlight unit of claim 4, further comprising a discharge controller which outputs the discharge control signal based on a duty ratio of an externally applied dimming control signal.

7. The backlight unit of claim 6, wherein the discharge controller outputs the discharge control signal when a duty ratio of the dimming control signal is greater than a predetermined reference duty ratio.

8. The backlight unit of claim 1, wherein the light source controller comprises:

a light source driving current detector which generates a detection voltage based on a light source driving current of the light source generated based on the light source driving voltage;

a feedback signal generator which generates a feedback signal based on one of the first and second soft start voltages and the detection voltage;

an output controller which generates a switch control signal based on the feedback signal;

a power converter which converts an externally applied input voltage into a light source driving voltage based on the switch control signal to apply the converted light source driving voltage to the light source;

a dimming controller which controls the light source driving current based on an externally applied dimming control signal; and a soft start controller which controls the soft starter based on the dimming control signal.

9. The backlight unit of claim 8, further comprising a discharge switching element controlled based on an externally applied discharge control signal, the discharge switching element connected between ground and an input terminal of the dimming controller to which the dimming control signal is input.

10. The backlight unit of claim 8, further comprising a discharge switching element controlled based on an externally applied discharge control signal, the discharge switching element connected between an output terminal of the power converter and ground.

11. The backlight unit of claim 8, wherein the soft start controller supplies the charge signal to the soft starter during a duty-on period of the dimming control signal.

12. The backlight unit of claim 11, wherein an electric connection between the soft start controller and the soft starter is cut off during a duty-off period of the dimming control signal.

* * * * *